US009377729B1

(12) United States Patent
Nakamura et al.

(10) Patent No.: US 9,377,729 B1
(45) Date of Patent: Jun. 28, 2016

(54) IMAGE FORMING APPARATUS THAT CORRECTS A TEMPERATURE OF A HEATER

(71) Applicant: FUJI XEROX CO., LTD., Tokyo (JP)

(72) Inventors: Satoshi Nakamura, Kanagawa (JP); Yoshihiro Hayashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/799,628

(22) Filed: Jul. 15, 2015

(30) Foreign Application Priority Data

Mar. 19, 2015 (JP) ..... 2015-056711

(51) Int. Cl.
*G03G 15/20* (2006.01)
*G03G 15/00* (2006.01)

(52) U.S. Cl.
CPC ..... *G03G 15/2039* (2013.01); *G03G 15/6585* (2013.01)

(58) Field of Classification Search
CPC ..... G03G 15/2039; G03G 15/6585; G03G 15/5058
USPC ..... 399/49, 69
See application file for complete search history.

(56) References Cited

U.S. PATENT DOCUMENTS 8,577,230 B2 * 11/2013 Yamashina ..... G03G 15/2039 399/15
8,582,995 B2 * 11/2013 Gomi ..... G03G 15/065 399/49
8,892,019 B2 * 11/2014 Hirayama ..... G03G 15/2021 399/122
8,983,324 B2 * 3/2015 Kiuchi ..... G03G 15/2028 399/67
2006/0198660 A1 * 9/2006 Bessho ..... G03G 15/5062 399/223
2012/0014702 A1 * 1/2012 Takemura ..... G03G 15/0126 399/46

FOREIGN PATENT DOCUMENTS

JP 2007-264263 A 10/2007
JP 2013-195635 A 9/2013

* cited by examiner

*Primary Examiner* — Clayton E LaBalle
*Assistant Examiner* — Trevor J Bervik
(74) *Attorney, Agent, or Firm* — Sughrue Mion, PLLC

(57) ABSTRACT

An image forming apparatus includes a transport unit that transports a recording medium, a forming unit that forms a toner image including a test pattern, a fixing unit that heats the toner image formed on the recording medium by the forming unit and fixes the toner image on the recording medium, and a controller that controls an amount of heat to be applied to the toner image by the fixing unit, on the basis of a difference between an amount of toner of the test pattern formed by the forming unit and a predetermined reference amount of toner.

12 Claims, 6 Drawing Sheets

| DIFFERENCE IN TEST PATTERN DENSITY | DIFFERENCE IN TONER AMOUNT | CORRECTION TEMPERATURE |
|---|---|---|
| $-\Delta Rx$ | $-\Delta Tx$ | $+\alpha x$ |
| ... | ... | ... |
| $-\Delta R1$ | $-\Delta T1$ | $+\alpha 1$ |
| 0 | 0 | 0 |
| $+\Delta R1$ | $+\Delta T1$ | $+\beta 1$ |
| ... | ... | ... |
| $+\Delta Rx$ | $+\Delta Tx$ | $+\beta x$ |

| DIFFERENCE IN TEST PATTERN DENSITY | DIFFERENCE IN TONER AMOUNT | CORRECTION SPEED |
|---|---|---|
| $-\Delta Rx$ | $-\Delta Tx$ | $-\gamma x$ |
| ... | ... | ... |
| $-\Delta R1$ | $-\Delta T1$ | $-\gamma 1$ |
| 0 | 0 | 0 |
| $+\Delta R1$ | $+\Delta T1$ | $-\varepsilon 1$ |
| ... | ... | ... |
| $+\Delta Rx$ | $+\Delta Tx$ | $-\varepsilon x$ |

FIG. 9

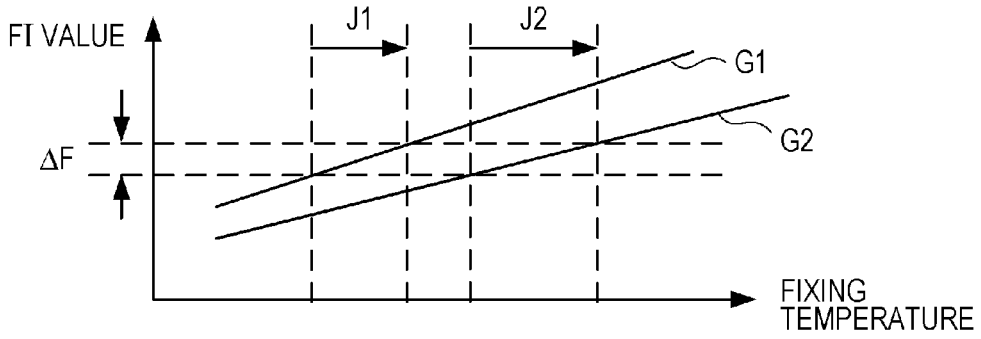

FIG. 10

| SITUATION | DIFFERENCE IN TEST PATTERN DENSITY | DIFFERENCE IN TONER AMOUNT | CORRECTION TEMPERATURE |
|---|---|---|---|
| REFERENCE TEMPERATURE ≥ THRESHOLD, RECORDING MEDIUM = THIN PAPER | ... | ... | ... |
| | ... | ... | ... |
| REFERENCE TEMPERATURE < THRESHOLD, RECORDING MEDIUM = THIN PAPER | ... | ... | ... |
| | ... | ... | ... |
| REFERENCE TEMPERATURE ≥ THRESHOLD, RECORDING MEDIUM = THICK PAPER | ... | ... | ... |
| | ... | ... | ... |
| REFERENCE TEMPERATURE < THRESHOLD, RECORDING MEDIUM = THICK PAPER | ... | ... | ... |
| | ... | ... | ... |

FIG. 11A

| DIFFERENCE IN TEST PATTERN DENSITY | CORRECTION TEMPERATURE |
|---|---|
| ... | ... |
| ... | ... |

FIG. 11B

| DIFFERENCE IN TONER AMOUNT | CORRECTION TEMPERATURE |
|---|---|
| ... | ... |
| ... | ... |

FIG. 12

| DIFFERENCE IN TEST PATTERN DENSITY | SET TEMPERATURE |
|---|---|
| $-\Delta Rx$ | T1 |
| ... | ... |
| $-\Delta R1$ | Tx |
| 0 | Tx + 1 |
| $+\Delta R1$ | Tx + 2 |
| ... | ... |
| $+\Delta Rx$ | T2x + 1 |

IMAGE FORMING APPARATUS THAT CORRECTS A TEMPERATURE OF A HEATER

CROSS-REFERENCE TO RELATED APPLICATIONS

This application is based on and claims priority under 35 USC 119 from Japanese Patent Application No. 2015-056711 filed Mar. 19, 2015.

BACKGROUND

Technical Field

The present invention relates to an image forming apparatus.

SUMMARY

According to an aspect of the invention, there is provided an image forming apparatus including: a transport unit that transports a recording medium; a forming unit that forms a toner image including a test pattern; a fixing unit that heats the toner image formed on the recording medium by the forming unit and fixes the toner image on the recording medium; and a controller that controls an amount of heat to be applied to the toner image by the fixing unit, on the basis of a difference between an amount of toner of the test pattern formed by the forming unit and a predetermined reference amount of toner.

BRIEF DESCRIPTION OF THE DRAWINGS

An exemplary embodiment of the present invention will be described in detail based on the following figures, wherein:

FIG. 9 is a diagram for explaining the control table according to the modification;

FIG. 10 illustrates an example of a control table according to a modification;

FIGS. 11A and 11B illustrate examples of control tables according to a modification; and FIG. 12 illustrates an example of a control table according to a modification.

DETAILED DESCRIPTION

1. Exemplary Embodiment

Figure 1:
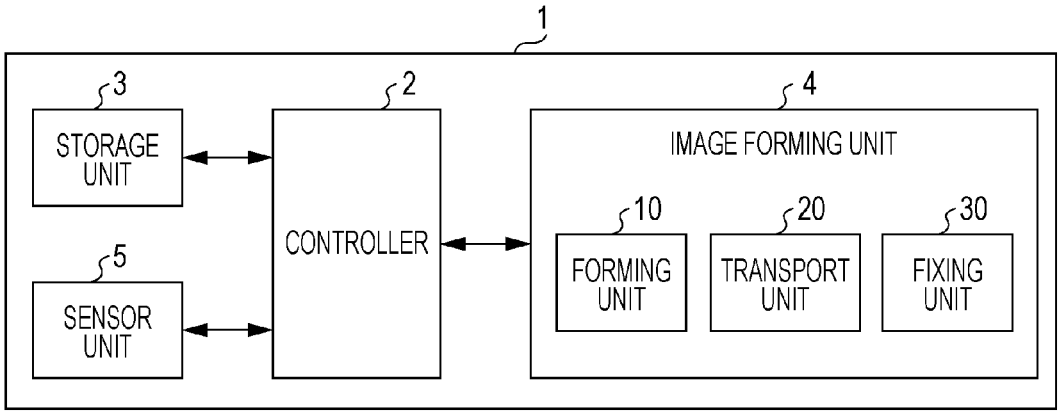
FIG. 1 illustrates the configuration of an image forming apparatus according to an exemplary embodiment.

FIG. 1 illustrates the configuration of an image forming apparatus 1 according to an exemplary embodiment. The image forming apparatus 1 includes a controller 2, a storage unit 3, an image forming unit 4, and a sensor unit 5. The controller 2 includes a central processing unit (CPU), a read only memory (ROM), a random access memory (RAM), and a real-time clock. The CPU controls the operation of each device by executing programs stored in the ROM and the storage unit 3 while using the RAM as a work area. The real-time clock calculates the current date and time and transmits the calculated current date and time to the CPU.

The controller 2 is connected to an external apparatus via a communication line (not illustrated). When image data is transmitted from the external apparatus, the controller 2 controls the image forming unit 4 so as to form an image represented by the received image data on a recording medium. That is, the image forming apparatus 1 is a computer that generally processes information representing an image using the CPU. The storage unit 3 includes a hard disk, and stores data and programs used for control by the CPU.

The image forming unit 4 fixes toner images formed with toners of six colors of yellow (Y), magenta (M), cyan (C), black (K), gold (G), and silver (S), respectively, onto the recording medium so at to form a color image. Each of the toners of G and S is a metallic toner containing flat metallic pigment particles. When the surfaces of the metallic pigment particles are aligned with the surface of the recording medium, an image that is glossy like metal is formed.

The image forming unit 4 includes a forming unit 10, a transport unit 20, and a fixing unit 30. The transport unit 20 transports a recording medium, and the forming unit 10 forms a toner image. The forming unit 10 forms a toner image on a photoconductor drum, performs a first transfer of the toner image so as to form a toner image on an intermediate transfer belt, and performs a second transfer of the toner image so as to form a toner image on the recording medium transported by the transport unit 20. The fixing unit 30 heats the toner image that is formed on the recording medium by the forming unit 10 so as to fix the toner image on the recording medium. The details of the image forming unit 4 will be described with reference to FIG. 2.

Figure 2:
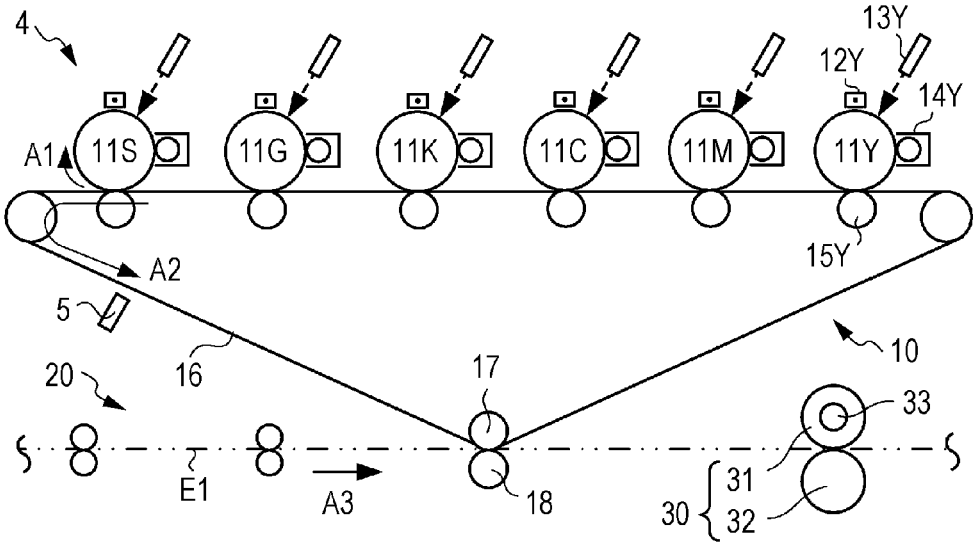
FIG. 2 illustrates the detailed configuration of an image forming unit.

FIG. 2 illustrates the detailed configuration of the image forming unit 4. The forming unit 10 of the image forming unit 4 includes a photoconductor drum 11, a charging unit 12, an exposure unit 13, a developing unit 14, a first transfer roller 15, an intermediate transfer belt 16, a second transfer roller 17, and a backup roller 18. The photoconductor drum 11, the charging unit 12, the exposure unit 13, the developing unit 14, and the first transfer roller 15 are arranged for each of the colors of Y, M, C, K, G, and S in this order along the intermediate transfer belt 16 in a belt rotation direction A2 indicated by the arrow in FIG. 2.

In FIG. 2, an alphabetic character (Y, M, C, K, G, or S) is added at the end of the reference numeral of each of the components described above so as to indicate that the component is a component for forming a toner image of the color corresponding to the alphabetic character. For purposes of clarity of the drawing, the components are all labeled as for the color Y, and only the photoconductor drum 11 is labeled as for the other colors. In the following, when these components do not need to be particularly distinguished from one another, the components are denoted by the reference numerals without the alphabetic character at the end.

The photoconductor drum 11 includes a photosensitive layer. While the photoconductor drum 11 rotates in a drum rotation direction A1 indicated by the arrow in FIG. 2, an electrostatic latent image is held on the surface of the photosensitive layer, and toner is supplied to the electrostatic latent image such that a toner image is developed and held thereon. The charging unit 12 charges the photosensitive layer of the photoconductor drum 11 such that the surface thereof has a predetermined charge potential. The exposure unit 13 exposes the photosensitive layer by irradiating exposure light onto the charged photosensitive layer while controlling the intensity and the irradiation position of the exposure light in accordance with the image data described above. Thus, an electrostatic latent image representing an image that is represented by the image data is formed on the photosensitive layer.

The developing unit 14 includes a developing roller that attracts and transports charged toner. The developing unit 14 applies a developing bias voltage to the photoconductor drum 11 and the developing roller so as to supply toner from the developing roller to the photoconductor drum 11, and thereby develops the electrostatic latent image. Thus, a toner image visualized with toner is formed on a portion where the electrostatic latent image has been present. The first-transfer roller 15 is disposed in a position so as to face the photoconductor drum 11 with the intermediate transfer belt 16 therebetween. A potential difference is generated between the photoconductor drum 11 and the intermediate transfer belt 16 by a voltage applied to the first transfer roller 15 and the photoconductor drum 11, so that the toner image formed on the photoconductor drum 11 is transferred onto the intermediate transfer belt 16 (so-called first transfer).

The intermediate transfer belt 16 is an endless belt, and is an image carrier that holds the first-transferred toner image. The intermediate transfer belt 16 is rotatably supported by plural support rollers, and is provided with a driving force so as to rotate in the belt rotation direction A2. Toner images of the colors Y, M, C, K, G and S are first-transferred onto the intermediate transfer belt 16 sequentially starting from the photoconductor drum 11Y. The toner images first-transferred on the intermediate transfer belt 16 are transferred onto a recording medium (so-called second transfer) as will be described below. That is, the intermediate transfer belt 16 is an example of an image carrier that holds a toner image to be transferred onto a recording medium.

The second-transfer roller 17 and the backup roller 18 are disposed so as to face each other with the intermediate transfer belt 16 therebetween and thus to form a nip part. The transport unit 20 includes plural rollers, and transports the recording medium along a transport path E1 passing through the nip part in a transport direction A3. The recording medium transported by the transport unit 20 comes into contact with the intermediate transfer belt 16 at the nip part. A voltage is applied to the second transfer roller 17 so as to generate a voltage difference with respect to the backup roller 18. With this voltage, the toner image held on the intermediate transfer belt 16 is second-transferred onto the recording medium. In the manner described above, the forming unit 10 forms the toner image on the recording medium.

The fixing unit 30 includes fixing rollers 31 and 32. The fixing rollers 31 and 32 are disposed so as to face each other with the transport path E1 therebetween and thus to form a nip area. The fixing roller 31 includes a heater 33 therein. The heater 33 generates heat under the control of the controller 2. The heater 33 is controlled based on a set temperature. The set temperature is associated with the output of the heater 33. Thus, the controller 2 performs control so as to cause the heater 33 to provide an output associated with the set temperature. With this control, the temperature at the heater 33 or a predetermined location therearound becomes the set temperature.

When the controller 2 performs control based on the set temperature so as to cause the heater 33 to generate heat, the outer periphery of the fixing roller 31 is heated to the fixing temperature. Via this outer periphery heated to the fixing temperature, the heater 33 heats the toner image that is formed on the recording medium transported to the nip area. Thus, the fixing unit 30 heats the toner image that is formed on the recording medium by the forming unit 10 so as to fix the toner image on the recording medium. The toner image thus fixed on the recording medium is the image formed on the recording medium by the image forming unit 4 (the image represented by the image data).

The forming unit 10 forms a test pattern on the intermediate transfer belt 16, other than the toner image representing the image data. The forming unit 10 forms the test pattern in an area other than the image area where the toner image of the image represented by the image data is formed, on the outer peripheral surface of the intermediate transfer belt 16 (for example, a first area downstream of the image area of an image at the top in the belt rotation direction A2, or a second area between successive image areas). This test pattern is a toner image of colors (Y, M, C, K, G, and S) with a uniform density, for example. In the case of the first area, the forming unit 10 forms a test pattern of six colors. In the case of the second area, the forming unit 10 forms a test pattern of, for example, one or two colors because the second area is not large enough to accommodate a test pattern of six colors.

The sensor unit 5 is disposed close to the outer periphery (that is, the surface on which the test pattern is formed) of the intermediate transfer belt 16, at the downstream side of the photoconductor drums 11 of the respective colors and at the upstream side of the second transfer roller 17 in the belt rotation direction A2. The sensor unit 5 measures a value (which may be referred to as RADC) obtained by dividing the amount of light irradiated to the test pattern by the amount of reflected light of that light, as a value representing the density of the test pattern. The test pattern whose density is measured is removed from the intermediate transfer belt 16 without being second-transferred. The sensor unit 5 provides density data indicating the measured density to the controller 2 of FIG. 1. The sensor unit 5 is an example of a "measuring unit" of the invention.

The controller 2 controls the amount of heat to be applied to the toner image by the fixing unit 30, on the basis of the difference between the amount of toner of the test pattern formed by the forming unit 10 and a predetermined reference amount of toner. The controller 2 controls the surface temperature of the fixing roller 31, that is, the fixing temperature, and thereby controls the amount of heat to be applied to the toner image. More specifically, the controller 2 controls the fixing temperature by controlling the set temperature of the heater 33, and thereby controls the amount of heat. Since it is possible to measure the relationship between the set temperature and the fixing temperature in advance, the controller 2 controls the fixing temperature on the basis of data indicating the relationship. Note that, although the set temperature and the fixing temperature are described as different temperatures in the exemplary embodiment, the fixing temperature may be used as the set temperature.

As the amount of toner of a test pattern, the toner mass area (TMA: the unit is, for example, $g/cm^2$) representing the amount of toner per unit area in the case where the test pattern is formed on a recording medium, for example. The TMA of the test pattern corresponds to the value of the density of the test pattern on the intermediate transfer belt 16.

The storage unit 3 stores relationship data indicating the relationship between the density of the test pattern and the TMA. The controller 2 obtains the TMA of the test pattern on the basis of the relationship data and the density that is indicated by the density data provided by the sensor unit 5. In the exemplary embodiment, the amount of toner that maximizes the glossiness of a toner image of the above-described metallic toner (toners of G and S) fixed on a recording medium is determined as the reference amount of toner. The glossiness is represented by the Flop Index (FI) value, for example. The reference amount of toner is determined in advance on the basis of the measurement results of the FI values of plural toner images with different amounts of toner which are fixed on a recording medium, for example. An example of the measurement results is illustrated in FIG. 3.

Figure 3:
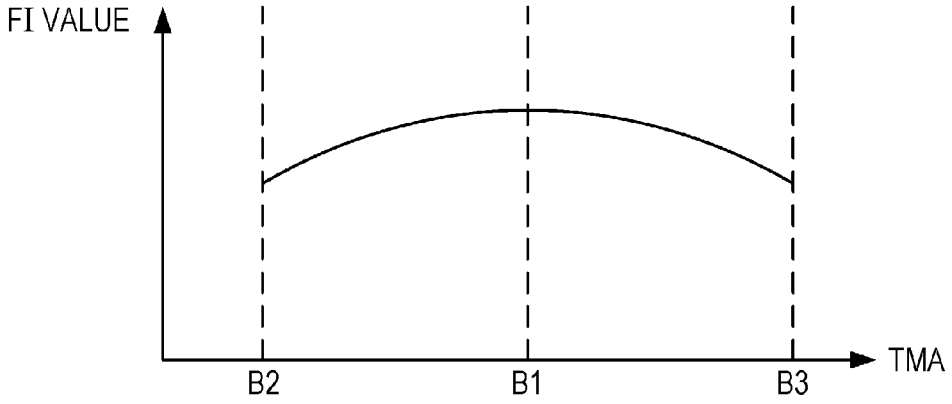
FIG. 3 illustrates an example of the relationship between the FI value of a toner image and the TMA.

FIG. 3 illustrates an example of the relationship between the FI value of a toner image and the TMA. The FI value is, for example, a value measured in accordance with ASTM E2194 (for example, measured with the light source set at −45 degrees with respect to the normal to the surface of the recording medium, and reception of light set at 30 degrees, 0 degree, and −65 degrees). The FI value is an index indicating the metallic glossiness. As the specular reflectance increases and thus the diffuse reflectance decreases, the FI value increases. As illustrated in FIG. 3, in a toner image formed with metallic toner, the FI value is maximized when the TMA is a certain value (B1 in this example). Regardless of whether the TMA is less than or greater than that value, the FI value decreases as the difference increases. The reason for this will be described with reference to FIGS. 4A through 4C.

Figure 4A:
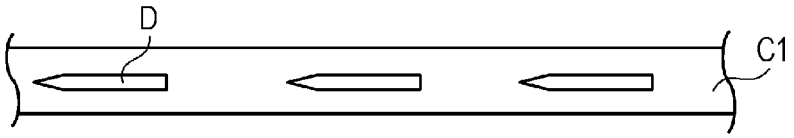
FIGS. 4A through 4C illustrate examples of the states of metallic pigment particles in toner images.
Figure 4B:
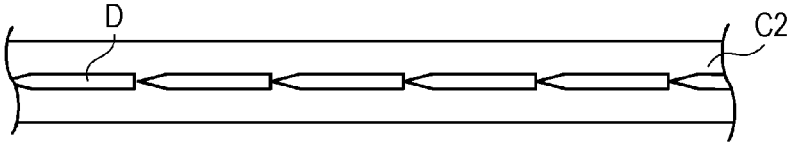
Figure 4C:
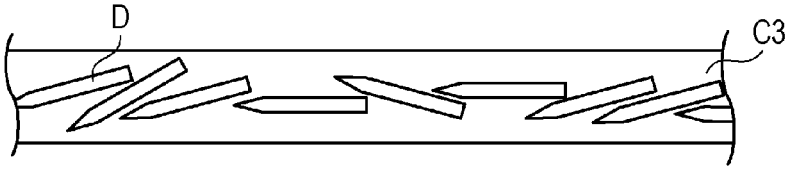

FIGS. 4A through 4C each illustrate an example of the state of metallic pigment particles in a toner image. FIGS. 4A through 4C illustrate the states of metallic pigment particles D in toner images C1, C2, and C3, respectively. The toner image C2 has a greater TMA than the toner image C1, and the toner image C3 has a greater TMA than the toner image C2. In the toner image C2, the surfaces of the metallic pigment particles D are aligned with the surface of the recording medium, and the metallic pigment particles D are closely arranged without gaps therebetween. This state is a state that maximizes the FI value of a toner image (including a test pattern).

On the other hand, in the toner image C1, the number of metallic pigment particles D is less than that of the toner image C2. Therefore, although the surfaces of the metallic pigment particles D are aligned with the surface of the recording medium, there are gaps between the metallic pigment particles D. Accordingly, the toner image C1 has a lower specular reflectance and hence a lower FI value than the toner image C2. Further, in the toner image C3, since the number of metallic pigment particles D is greater than that of the toner image C2, the metallic pigment particles D are closely arranged without gaps therebetween. However, the metallic pigment particles D overlap each other, so that their surfaces are inclined with respect to the surface of the recording medium. Accordingly, the toner image C3 has a lower specular reflectance and hence a lower FI value than the toner image C2.

The TMA changes over time due to factors such as a change in the state of the surfaces of the rollers used for development and transfer. In the exemplary embodiment, the controller 2 controls the TMA to be greater than or equal to B2 (B2<B1) and less than or equal to B3 (B3>B1) as illustrated in FIG. 3. The controller 2 changes the developing bias in the developing unit 14 and the amount of exposure light of the exposure unit 13 so as to adjust the amount of toner supplied to the photoconductor drum 11, and thereby controls the TMA, for example. Since this control is performed, the TMA varies in the range greater than or equal to B2 and less than or equal to B3.

The controller 2 controls the fixing temperature so as to increase the FI value when the TMA is small.

Figures 5, 6:
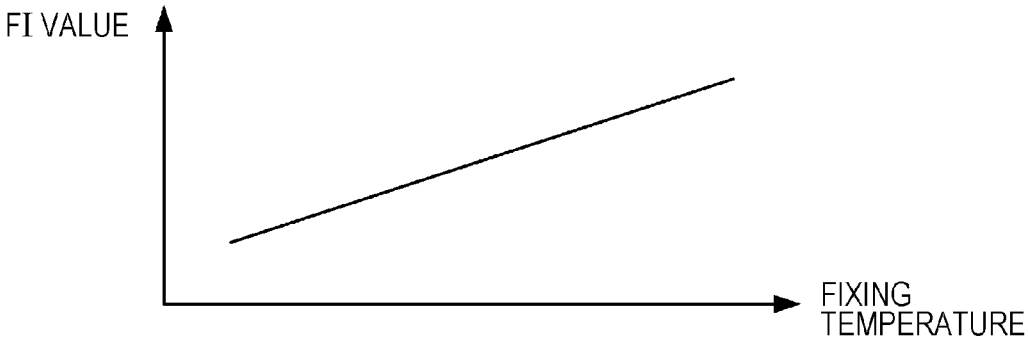
FIG. 5 illustrates an example of the relationship between the FI value and the fixing temperature.
FIG. 6 illustrates an example of a control table.

FIG. 5 illustrates an example of the relationship between the FI value and the fixing temperature. In FIG. 5, a graph in which the horizontal axis represents the fixing temperature and the vertical axis represents the FI value is illustrated. As indicated in the graph, as the fixing temperature increases, the FI value increases. This is because as the fixing temperature increases, the toner becomes softer so that the surface of the toner image becomes smoother, and the specular reflectance increases so that the diffuse reflectance decreases. By using this relationship, the controller 2 controls the above-described set temperature (the temperature used for controlling the heater 33) so as to increase the fixing temperature when the TMA is low.

More specifically, the controller 2 corrects the set temperature in accordance with the difference described above (the difference between the amount of toner of the test pattern and the reference amount of toner). In this exemplary embodiment, a reference temperature serving as the reference for the set temperature is determined in advance, and the controller 2 corrects the set temperature by correcting the reference temperature. The reference temperature is determined on the basis of the performance of the apparatus and the properties of the recording medium. The controller 2 performs this control using a control table illustrated in FIG. 6, for example.

FIG. 6 illustrates an example of the control table. In this control table, the difference in the test pattern density, the difference in the amount of toner, and the correction temperature are associated with each other. The difference in the amount of toner is the difference between the amount of toner of the above-described test pattern and the reference amount of toner. Illustrated are the differences ranging from "−ΔT1" to "−ΔTx (x is a natural number greater than 1)" in the case where the amount of toner of the test pattern is less, and the difference ranging from "+ΔT1" to "+ΔTx" in the case where the amount of toner of the test pattern is greater, with the difference "0" therebetween. As for all of these differences, as the natural number at the end increases, the absolute value increases.

The difference in the test pattern density is the difference between the density of a test pattern and the density (hereinafter referred to as a "reference density") of a test pattern formed when the difference in the amount of toner is "0", that is, formed with the reference amount of toner. This reference density is the density associated with the value of the TMA of the reference amount of toner in the above-described relationship data (data indicating the relationship between the test pattern density and the TMA). Differences in the density of "−ΔR1" through "−ΔRx" are associated with differences in the amount of toner of "−ΔT1" through "−ΔTx", respectively. Further, differences in the density of "+ΔR1" through "+ΔRx" are associated with differences in the amount of toner of "+ΔT1" through "+ΔTx", respectively. As for all of these differences in the density as well, as the natural number at the end increases, the absolute value increases.

The correction temperature is the temperature that is added to the reference temperature by the controller 2. Correction temperatures of "+α1" through "+αx" are associated with differences in the amount of toner of "−ΔT1" through "−ΔTx", respectively. Further, correction temperatures of "+β1" through "+βx" are associated with differences in the amount of toner of "+ΔT1" through "+ΔTx", respectively. As for all of these correction temperatures as well, as the natural number at the end increases, the absolute value increases. Further, each of the correction temperatures has a positive value, as indicated by the "+" sign thereof.

The controller 2 calculates a difference between the density which is indicated by the density data provided by the sensor unit 5 and the above-described reference density, and adds a correction temperature associated with the calculated difference to the reference temperature. The controller 2 controls the heater 33 by setting the thus calculated temperature as the set temperature, so that the surface temperature of the fixing roller 31 increases to the fixing temperature corresponding to the set temperature. Thus, the fixing temperature becomes higher than that in the case where the difference in the density and the difference in the amount of toner are 0, regardless of whether the test pattern density is greater or less than the reference density, in other words, regardless of whether the amount of toner of the test pattern is greater or less than the reference amount of toner. In this way, in the case where the amount of toner that maximizes the glossiness of a toner image fixed on a recording medium is the reference amount of toner, the toner the controller 2 performs a correction that increases the set temperature of the heater 33 (compared to the case where the difference is 0), that is, corrects the set temperature to a temperature higher than the reference temperature, regardless of whether the difference between the reference amount of toner and the amount of toner of the test pattern is positive or negative.

With the configuration described above, the image forming apparatus 1 performs a process for controlling the amount of heat applied to a toner image upon fixing.

Figures 7, 8:
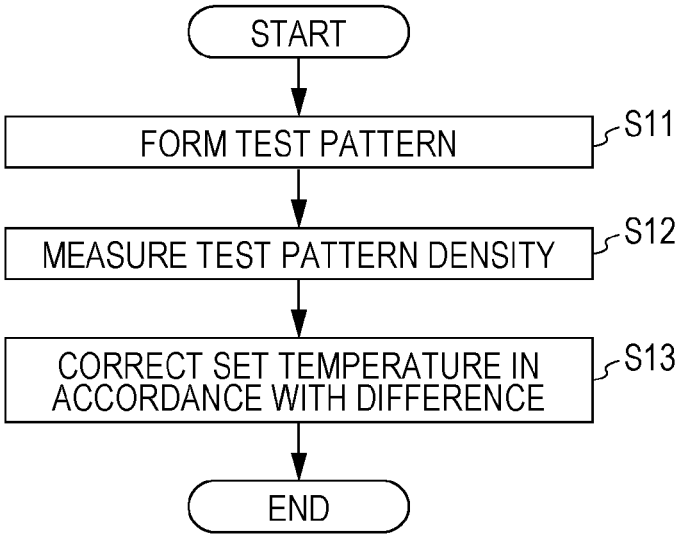
FIG. 7 illustrates an example of an operational procedure of the image forming apparatus in a process of controlling the fixing temperature.
FIG. 8 illustrates an example of a control table according to a modification.

FIG. 7 illustrates an example of an operational procedure of the image forming apparatus 1 in a control process. This control process is performed before formation of an image represented by image data is started or during image formation. First, the image forming apparatus 1 forms a test pattern on the intermediate transfer belt 16 (step S11). Then, the image forming apparatus 1 measures the density of the test pattern (step S12), and corrects the set temperature in accordance with the difference in the test pattern density, that is, the difference in the amount of toner described above, on the basis of the measured density (step S13). The operation of step S11 is performed by the forming unit 10; the operation of step S12 is performed by the sensor unit 5; and the operation of step S13 is performed by the controller 2.

When the amount of toner changes, the glossiness of the toner image fixed on the recording medium changes as described above with reference to FIG. 3. However, in the exemplary embodiment, the set temperature and the fixing temperature are controlled on the basis of the difference between the amount of toner of the test pattern and the reference amount of toner. Thus, by performing control that, for example, increases the set temperature and the fixing temperature so as to increase the glossiness when the glossiness is low due to a change in the amount of toner, and reduces the set temperature and the fixing temperature so as to reduce the glossiness when, in contrast, the glossiness is high, a change in the glossiness may be suppressed when there is a change in the amount of toner of a toner image fixed on a recording medium, compared to the case where control based on the difference in the amount of toner is not performed.

Further, in the exemplary embodiment, since the set temperature is controlled, there is no need to change the transport speed, for example. Accordingly, control based on the difference in the amount of toner is performed without changing the time required for image formation. Further, in the exemplary embodiment, the focus is placed on the relationship between the amount of toner in a toner image of the metallic toner described with reference to FIG. 3 and FIGS. 4A through 4C and the glossiness, a correction is performed so as to increase the set temperature (make the set temperature higher than the reference temperature), regardless of whether the difference from the reference amount of toner is positive or negative. Thus, a change in the glossiness (more specifically, metallic glossiness) may be suppressed when there is a change in the amount of toner of a toner image containing flat metallic pigment particles, compared to the case where control based on the difference in the amount of toner is not performed.

2. Modifications

The above-described exemplary embodiment is a mere example of implementation of the present invention, and modifications may be made as described below. Further, the above-described exemplary embodiment and the following modifications may be implemented in combination as needed.

2-1. Controlling Heating Time

The controller 2 may control the amount of heat applied to a toner image with a method different from the one used in the exemplary embodiment. The controller 2 controls the amount of heat by, for example, controlling the heating time of the toner image. The heating time is the length of time during which a toner image is heated, is time needed for an arbitrary portion of a recording medium (for example, the leading edge of a recording medium) to pass the nip area formed by the fixing rollers 31 and 32.

The controller 2 controls the above-described amount of heat by, for example, transporting a recording medium at a transport speed corresponding to the difference in the amount of toner of a test pattern and the reference amount of toner. The transport unit 20 of the present modification has a transport speed that may be controlled by the controller 2. If the width of the nip area of the fixing unit 30 in the transport direction A3 is constant, the heating time is inversely proportional to the transport speed. Further, as in the case of the fixing temperature illustrated in FIG. 5, as the heating time increases, the amount of heat applied to a toner image increases, and thus the FI value of the fixed toner image increases. Accordingly, as the absolute value of the above difference increases, the controller 2 reduces the transport speed, and thus increases the heating time.

FIG. 8 illustrates an example of a control table according to the present modification. In this control table, the difference in the test pattern density, the difference in the amount of toner, and the correction speed are associated with each other. The controller 2 controls the transport unit 20 so as to set the transport speed to a speed obtained by adding the correction speed to a reference speed. The reference speed is a speed that is determined in advance as the reference for the transport speed. Correction speeds of "$-\gamma 1$" through "$-\gamma x$" are associated with differences in the amount of toner of "$-\Delta T1$" through "$-\Delta Tx$", respectively. Further, correction speeds of "$-\epsilon 1$" through "$-\epsilon x$" are associated with differences in the amount of toner of "$+\Delta T1$" through "$+\Delta Tx$", respectively. As for all of these correction speeds, as the natural number at the end increases, the absolute value increases. Further, each of the correction speeds has a negative value, as indicated by the "$-$" sign thereof.

The controller 2 calculates a difference between the density which is indicated by the density data provided by the sensor unit 5 and the above-described reference density, and adds a correction speed associated with the calculated difference to the reference speed. The controller 2 controls the transport unit 20 so as to transport a recording medium at the calculated speed in the vicinity of the fixing unit 30. Thus, regardless of whether the amount of toner of the test pattern is greater or less than the reference amount of toner, the heating time is increased compared to the case where the difference in the amount of toner is 0, so that the amount of heat applied to the toner image is increased.

As described above, in the case where the amount of toner that maximizes the glossiness of a toner image fixed on a recording medium is the reference amount of toner, the controller 2 reduces the transport speed, regardless of whether the difference between the reference amount of toner and the amount of toner of the test pattern is positive or negative. Thus, as in the exemplary embodiment, a change in the glossiness may be suppressed in the case where a toner image containing flat metallic pigment particles is used. Further, in the present modification, since the control based on the difference in the amount of toner is performed by controlling the transport unit 20, the controller 2 does not need to change the set temperature of the heater 33.

Note that in the case where the fixing unit 30 is capable of changing the nip width as the width of the nip area in the transport direction (the nip width increases as the distance between rollers decreases) by changing the roller-to-roller distance between the fixing rollers 31 and 32, the controller 2 may change the heating time by changing the width.

2-2. Controlling Amount of Heat

In the exemplary embodiment, the controller 2 controls the amount of heat applied to a toner image using the control table. However, the present invention is not limited thereto. For example, the controller 2 may determine the set temperature by adding, to the reference temperature, a temperature calculated using a mathematical expression that represents the difference in the amount of toner of a test pattern and the reference amount of toner and the correction temperature. That is, the controller 2 may control the above-described amount of heat using information indicating the corresponding relationship between this difference and the correction temperature (examples of this information include a control table and the mathematical expression in the present modification). This may be applied to the case of controlling the transport speed or the nip width. In this case, the controller 2 controls the above-described amount of heat using information indicating the corresponding relationship between the transport speed or the nip width and the above-described difference.

2-3. Correction in Accordance with Reference Temperature

The above-described reference temperature (temperature serving as the reference for the set temperature) may be changed in accordance with the situation. This change is made by the controller 2. For example, since the amount of heat transferred from the toner image to a recording medium increases as the thickness of a recording medium increases (a thin recording medium has a small heat capacity, and therefore the amount of heat transferred from a toner image is limited), the controller 2 changes the reference temperature to a higher temperature so as to apply a sufficient amount of heat to the toner image. Also, in the case where the ambient temperature is low, the temperature of a toner image is low, and therefore the controller 2 changes the reference temperature to a higher reference temperature. The controller 2 uses different control tables when the reference temperature is greater than or equal to a threshold, and when the reference temperature is less than the threshold, for example.

FIG. 9 is a diagram for explaining the control table according to the present modification. In FIG. 9, a graph in which the horizontal axis represents the fixing temperature and the vertical axis represents the FI value is illustrated, as in the case of FIG. 5. In FIG. 9, lines G1 and G2 each representing the relationship between the fixing temperature and the FI value are illustrated. The line G1 represents the relationship in the case where plain paper is used as a recording medium, and the line G2 represents the relationship in the case where thick paper is used as a recording medium. The lines G1 and G2 differ in the increase (that is, inclination) at the time when the fixing temperature is increased. Therefore, an amount of increase J1 in the fixing temperature required to increase the FI value by ΔF in the case where the reference temperature corresponding to plain paper and an amount of increase J2 in the case where the reference temperature corresponding to thick paper are different from each other (J1<J2).

That is, if the reference temperature differs, the amount of increase in the fixing temperature required to increase the FI value by a common amount, and hence the correction temperature of the set temperature needed for that differs. Therefore, the controller 2 performs control using plural control tables that differ in the correction temperature corresponding to a common difference in the amount of toner. These plural tables are information indicating the corresponding relationship among the reference temperature, the correction amount of the set temperature (correction temperature), and the difference in the amount of toner, and are stored in the storage unit 3. The controller 2 determines the correction amount of the set temperature in accordance with the stored information and the current reference temperature. More specifically, the controller 2 determines the correction temperature using the control table of the plural control tables which corresponds to the reference temperature at the time when the forming unit 10 forms a toner image. Thus, a change in the glossiness of a toner image may be suppressed when there is a change in the situation, compared to the case where the reference temperature is not taken into consideration in controlling the amount of heat.

2-4. Correction in Accordance with Environment

If the environment such as a type of the recording medium, ambient temperature, and ambient humidity differs, the correction temperature required to increase the FI value by ΔF may differ. The controller 2 may control the amount of heat using information indicating the corresponding relationship among environment information indicating any of these environments, the correction amount of the set temperature, and the difference in the amount of toner. This information includes, for example, plural control tables corresponding to each of the environments, and is stored in the storage unit 3. The controller 2 determines the correction amount of the set temperature in accordance with the stored information and the current environment. Thus, a change in the glossiness of a toner image is suppressed when there is a change in the environment, compared to the case where these environments are not taken into consideration in controlling the amount of heat.

Note that plural control tables corresponding to combined environments of the type of the recording media and the ambient temperature may be used, for example. Further, plural control tables corresponding to a combination of the reference temperature described in the above modification and these environments may be used. In both cases, the controller 2 performs control on the basis of information indicating the corresponding relationship among the combination, the correction amount of the set temperature, and the difference in the amount of toner. The controller 2 corrects the reference temperature using a correction temperature corresponding to the current situation of a combination (a combination of the reference temperature and the above environments) and the difference in the amount of toner indicated by this information.

Note that the content represented in the plural control tables may be represented in a single control table.

FIG. 10 illustrates an example of a control table according to the present modification. In this example, there are the following four situations based on combinations of the reference temperature and the type of recording medium: "the reference temperature is greater than or equal to the threshold, and the recording medium is thin paper", "the reference temperature is less than the threshold, and the recording medium is thin paper", "the reference temperature is greater than or equal to the threshold, and the recording medium is thick paper", and "the reference temperature is less than the threshold, and the recording medium is thick paper". Each of these situations is associated with the difference in the test pattern density, the difference in the amount of toner, and the correction temperature. For example, if the situation is "the reference temperature is greater than or equal to the threshold, and the recording medium is thick paper", the controller 2 corrects the reference temperature using the correction temperature associated with the difference between the density of a test pattern measured in this situation and the reference density and this situation in the control table of FIG. 10.

In the case where control is performed using a single pattern of the corresponding relationship between the difference in the amount of toner and the correction temperature is performed although the situations described above are different from each other, when, for example, the FI value of a fixed toner image is less by ΔF due to a change in the amount of toner, even if the set temperature (and hence the fixing temperature) is increased by a correction, the FI value might not be increased by ΔF or might be increased by greater than ΔF, resulting in a change in the glossiness. According to the present modification, the control using the above-described information indicating the corresponding relationship is performed in accordance with the situation. Therefore, a change in the glossiness of a toner image may be suppressed when there is a change in the above-described situation, compared to the case where this control is not performed.

In the above example, information indicating the corresponding relationship between the difference in the amount of toner and the correction temperature is used. However, the present invention is not limited thereto. The controller 2 may control the transport speed using information indicating the corresponding relationship between the difference in the amount of toner and the above-described correction speed (speed for correcting the reference speed) in accordance with a situation. Further, the controller 2 may control the nip width using information indicating the corresponding relationship between the difference in the amount of toner and the correction amount of the nip width in accordance with a situation. In either case, a change in the glossiness of a toner image is suppressed when there is a change in the situation, compared to the case where these control processes are not performed.

2-5. Control Table

In the exemplary embodiment, the difference in the test pattern density, the difference in the amount of toner, and the correction temperature are associated with each other in the control table. However, the present invention is not limited thereto.

FIGS. 11A and 11B illustrate examples of control tables according to the present modification. In FIG. 11A, the difference in the test pattern density and the correction temperature are associated with each other. In FIG. 11B, the difference in the amount of toner and the correction temperature are associated with each other. The control table illustrated in FIG. 11A is used for control using the density of the test pattern measured by the sensor unit 5 as in the case of the exemplary embodiment. The control table illustrated in FIG. 11B is used in the case where the amount of toner of the toner image formed by the forming unit 10 is directly measured. The amount of toner is measured by suctioning a test pattern of a predetermined size, and measuring the mass thereof, for example. This measurement may be performed only when an image is not formed, and therefore may be performed in the case where, for example, correction with particularly high accuracy is needed.

2-6. Set Temperature in Accordance with Difference

The controller 2 may calculate the set temperature without using the correction temperature.

FIG. 12 illustrates an example of a control table according to the present modification. In the example of FIG. 12, the difference in the test pattern density is directly associated with the set temperature. "−ΔRx" is associated with "T1"; "−ΔR1" is associated with "Tx"; "0" is associated with "Tx+1"; "+ΔR1" is associated with "Tx+2"; and "+ΔRx" is associated with "T2x+1". In this case, "Tx+1" corresponds to the reference temperature. Note that in place of the mathematical expression representing the relationship between the difference in the amount of toner and the correction temperature described above, a mathematical expression representing the relationship between the difference in the amount of toner and the set temperature may be used. That is, the controller 2 may or may not use the correction temperature if the amount of heat to be applied to a toner image by the fixing unit 30 is controlled on the basis of the difference in the amount of toner. This also applies to the case of controlling the transport speed or the nip width.

2-7. Toner

In the exemplary embodiment, a metallic toner is used. However, a metallic toner may not be used. Even in this case, when the amount of toner changes, the glossiness of the fixed toner image changes. More specifically, as the amount of toner increases, the roughness of the surface of the recording medium becomes less apparent at the surface of the toner image, and thus the glossiness increases. Thus, for example, in the case of controlling the set temperature, if the amount of toner that maximizes the glossiness of a toner image fixed on a recording medium is determined as the reference amount of toner, the controller 2 corrects the set temperature to a temperature higher than the reference temperature when the reference amount of toner is greater than the amount of toner of the test pattern, and corrects the set temperature to a temperature lower than the reference temperature when the reference amount of toner is less. In this way, even when metallic toner is not used, a change in the glossiness is suppressed as in the case of the exemplary embodiment. Note that the glossiness may be represented by other values than the FI value. For example, the glossiness may be represented by a value measured using a well-known method defined in JIS P-8142. That is, as long as a value that represents the glossiness of a fixed toner image is measured, any method may be used for measuring the glossiness.

2-8. Sensor Unit

In the exemplary embodiment, the sensor unit 5 is disposed downstream of the photoconductor drum 11 in the belt rotation direction A2, and upstream of the second transfer roller 17 in the belt rotation direction A2. However, the present invention is not limited thereto. For example, the sensor unit 5 may be disposed downstream of the second transfer roller 17 in the belt rotation direction A2. Further, the sensor unit 5 may be disposed between adjacent photoconductor drums 11. Further, the forming unit 10 may second-transfer a test pattern onto a recording medium, and the sensor unit 5 may be disposed in a position downstream of the second-transfer roller 17 in the transport direction A3 and close to the transport path E1. In this case, the controller 2 obtains a TMA of the test pattern on the basis of relationship data indicating the relationship between the density of the test pattern on the recording medium and the TMA.

The sensor unit 5 may be disposed in a position that reduces delay in controlling the amount of heat. The delay in controlling the amount of heat indicates delay of time when a test pattern whose density is measured is formed with respect to time when a toner image that is fixed at a set temperature corrected in accordance with the density is formed. In the case where the toner image formed together with this test pattern is fixed at the corrected set temperature, the delay in controlling the amount of heat is 0. As this delay increases, it becomes more difficult to appropriately control the heat amount, and thus the glossiness of the fixed toner image becomes more likely to change.

In order to reduce this delay, the sensor unit 5 may be disposed so as to measure the amount of toner of a test pattern formed on the intermediate transfer belt 16 before the test pattern reaches the position where a second transfer is performed in the forming unit 10, as in the case of the exemplary embodiment, for example. Thus, the amount of toner is measured at an earlier timing, compared to the case where the amount of toner is measured after the test pattern passes the position of the second transfer (regardless of whether the second transfer of the test pattern is performed). Therefore, the delay in controlling the amount of heat may be reduced.

2-9. Image Forming Apparatus

In the above-described exemplary embodiment, the image forming apparatus forms a color image using plural photoconductor drums and plural developing units arranged along the intermediate transfer belt. However, the invention is not limited thereto. For example, the image forming apparatus may be one that includes a so-called rotary type developing unit in which developing units are disposed in the circumferential direction of a rotor, or may be a so-called direct transfer type image forming apparatus that directly transfers an image from a photoconductor drum to a recording medium.

2-10. Fixing Unit

In the exemplary embodiment, the fixing unit 30 heats only the fixing roller 31. However, the fixing unit 30 may heat both the fixing rollers 31 and 32. In this case, the set temperature of the two rollers may be different. Further, a toner image may be fixed by using a fixing belt in place of the fixing rollers. Further, the fixing unit may perform laser fixing. In this case, the controller 2 controls the amount of heat applied by the fixing unit to a toner image by controlling the intensity of laser.

2-11. Controlling Amount of Toner

In the exemplary embodiment, the controller 2 controls the amount of toner to be close to the reference amount of toner. However, this control is not necessarily required. Even in the case where this control is not performed, since the amount of toner changes over time, a change in the glossiness due to the change in the amount of toner is suppressed.

2-12. Reference Amount of Toner

In the exemplary embodiment, the amount of toner that maximizes the glossiness when a test pattern is fixed on a recording medium is determined as the reference amount of toner. However, the present invention is not limited thereto. For example, instead of the maximum glossiness, an amount of toner that produces the glossiness which is about 90% or 80% of the maximum glossiness may be determined as the reference amount of toner. That is, the amount of toner that makes the fixed toner image have a desired glossiness may be determined as the reference amount of toner.

2-13. Category of Invention

The present invention may be regarded as a processing method that implements a control process (a process for controlling the amount of heat applied to a toner image upon fixing) performed by an image forming apparatus. Further, the present invention may be regarded as a program for causing a computer that controls an image forming apparatus to perform the processing method. This program may be provided in the form of a recording medium such as an optical disc storing the program, or may be provided by being downloaded and installed in a computer via a communication line such as the Internet so as to be available.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transport unit configured to transport a recording medium;

a forming unit configured to form a toner image including a test pattern;

a fixing unit configured to heat the toner image formed on the recording medium by the forming unit and to fix the toner image on the recording medium; and a controller configured to control an amount of heat to be applied to the toner image by the fixing unit based on a difference between an amount of toner of the test pattern formed by the forming unit and a predetermined reference amount of toner, wherein the controller is configured to perform a correction that increases a set temperature of the heater, regardless of whether the difference between the predetermined reference amount of toner and the amount of toner of the test pattern is positive or negative.

2. The image forming apparatus according to claim 1, wherein the fixing unit includes a heater that heats the toner image; and wherein the controller is configured to correct a set temperature of the heater in accordance with the difference.

3. The image forming apparatus according to claim 2, further comprising:

a memory configured to store information indicating a corresponding relationship among environment information, a correction amount of the set temperature, and the difference, the environment information indicating any of environments including a type of the recording medium, ambient temperature, and ambient humidity;

wherein the controller is further configured to determine the correction amount of the set temperature in accordance with the stored information and the environment at a present time.

4. The image forming apparatus according to claim 2, wherein the set temperature is corrected by correcting a reference temperature, and wherein the reference temperature is changed in accordance with a situation, the image forming apparatus further comprising:

a memory configured to store information indicating a corresponding relationship among the reference temperature, a correction amount of the set temperature, and the difference;

wherein the controller is further configured to determine the correction amount of the set temperature in accordance with the stored information and the reference temperature at a present time.

5. The image forming apparatus according to claim 1, wherein the controller is configured to control the amount of heat by transporting the recording medium at a transport speed corresponding to the difference.

6. The image forming apparatus according to claim 1, wherein the forming unit includes an intermediate transfer belt, and is configured to transfer the toner image formed on the intermediate transfer belt to the recording medium, the image forming apparatus further comprising:

a measuring unit configured to measure the amount of toner of the test pattern formed on the intermediate transfer belt before the test pattern reaches a position where the transfer is performed;

wherein the controller is configured to control the amount of heat on the basis of the measured amount of toner.

7. The image forming apparatus according to claim 1, wherein the reference amount of toner is an amount of toner determined based on a Flop Index value of a toner image fixed on a recording medium.

8. The image forming apparatus according to claim 7, wherein the toner image includes flat metallic pigment particles.

9. The image forming apparatus according to claim 1, wherein the toner image includes flat metallic pigment particles.

10. An image forming apparatus comprising:

a transport unit configured to transport a recording medium;

a forming unit configured to form a toner image including a test pattern;

a fixing unit configured to heat the toner image formed on the recording medium by the forming unit and to fix the toner image on the recording medium; and a controller configured to control an amount of heat to be applied to the toner image by the fixing unit based on a difference between an amount of toner of the test pattern formed by the forming unit and a predetermined reference amount of toner, wherein the fixing unit includes a heater that heats the toner image, wherein the controller is configured to correct a set temperature of the heater in accordance with the difference, wherein the toner image includes flat metallic pigment particles, wherein the reference amount of toner is an amount of toner determined based on a Flop Index value of a toner image fixed on a recording medium, and wherein the controller is configured to perform a correction that increases the set temperature of the heater, regardless of whether the difference between the reference amount of toner and the amount of toner of the test pattern is positive or negative.

11. An image forming apparatus comprising:

a transport unit configured to transport a recording medium;

a forming unit configured to form a toner image including a test pattern;

a fixing unit configured to heat the toner image formed on the recording medium by the forming unit and to fix the toner image on the recording medium; and a controller configured to control an amount of heat to be applied to the toner image by the fixing unit based on a difference between an amount of toner of the test pattern formed by the forming unit and a predetermined reference amount of toner, wherein the reference amount of toner is an amount of toner that determined based on a Flop Index value of a toner image fixed on a recording medium.

12. The image forming apparatus according to claim 11, wherein the controller is configured to perform a correction that increases the set temperature of the heater, regardless of whether the difference between the reference amount of toner and the amount of toner of the test pattern is positive or negative.

* * * * *